US007079802B2

(12) United States Patent
Katayanagi et al.

(10) Patent No.: US 7,079,802 B2
(45) Date of Patent: Jul. 18, 2006

(54) FIXING DEVICE WITH SPECIFIC SURFACE ROUGHNESS

(75) Inventors: Hidetoshi Katayanagi, Hachioji (JP); Hajime Tanaka, Hachioji (JP); Toshiki Hayami, Hachioji (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/251,064

(22) Filed: Sep. 20, 2002

(65) Prior Publication Data

US 2003/0063916 A1 Apr. 3, 2003

(30) Foreign Application Priority Data

Sep. 28, 2001 (JP) ..... 2001-300477

(51) Int. Cl.
*G03G 15/20* (2006.01)

(52) U.S. Cl. ..... 399/331; 399/329; 399/333; 219/216

(58) Field of Classification Search ..... 399/328, 399/329, 330, 331, 333; 219/216
See application file for complete search history.

(56) References Cited

U.S. PATENT DOCUMENTS 5,250,998 A * 10/1993 Ueda et al. ..... 399/329
5,293,202 A * 3/1994 Adachi et al. ..... 399/323
5,345,300 A * 9/1994 Uehara et al. ..... 399/329
5,860,051 A * 1/1999 Goto et al. ..... 399/329
5,999,788 A * 12/1999 Kanesawa et al. ..... 399/329
6,131,010 A * 10/2000 Kume et al. ..... 399/333
6,226,488 B1 * 5/2001 Maeyama ..... 399/322
6,490,429 B1 * 12/2002 Okayasu et al. ..... 399/328
6,505,027 B1 * 1/2003 Takeuchi et al. ..... 399/328
6,519,426 B1 * 2/2003 Goto et al. ..... 399/69
6,733,944 B1 * 5/2004 Kadokura et al. ..... 430/124

FOREIGN PATENT DOCUMENTS

JP 61069085 A * 4/1986
JP 06-043774 2/1994
JP 06043774 A * 2/1994
JP 11153923 A * 6/1999
JP 2001142334 A * 5/2001

* cited by examiner

*Primary Examiner*—Robert Beatty
(74) *Attorney, Agent, or Firm*—Lucas & Mercanti, LLP

(57) ABSTRACT

An image forming apparatus equipped with a heat fixing device includes a heating member having an elastic layer on a substrate and a fluorine resin coated on the elastic layer, a pressure member having a substrate covered with a fluorine resin tube through an elastic layer or without the elastic layer in pressure contact with the heating member, and at least one heater as a heat source. The surface roughness of the fluorine resin of the heating member is greater than the surface roughness of the fluorine resin tube of the pressure member.

8 Claims, 9 Drawing Sheets

FIG. 9 ( a )
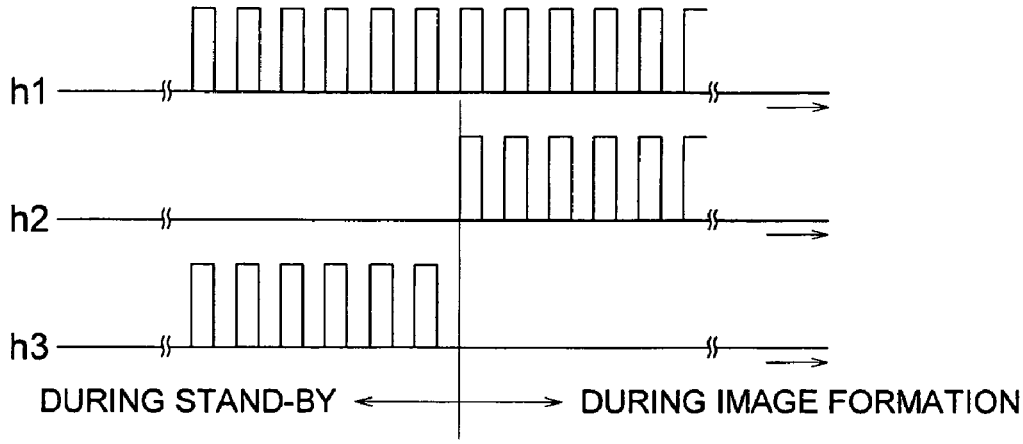
FIG. 9 ( b )
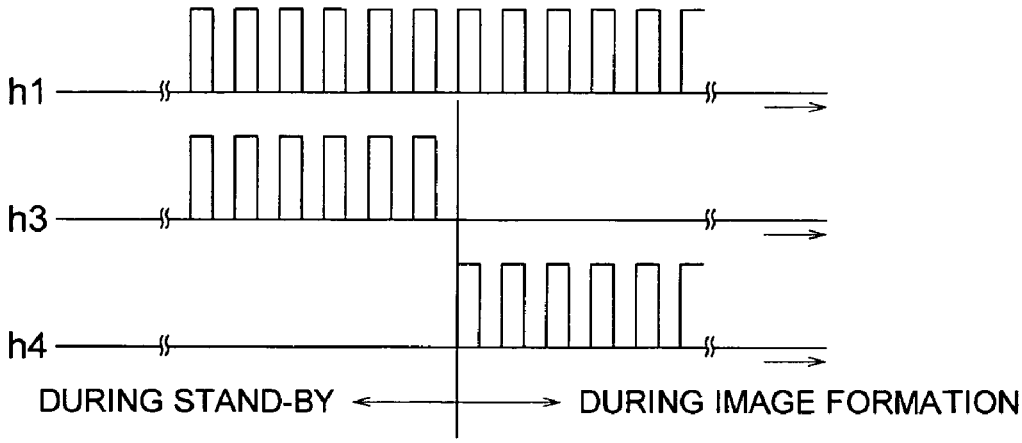

FIXING DEVICE WITH SPECIFIC SURFACE ROUGHNESS

BACKGROUND OF THE INVENTION

The present invention relates to an image forming apparatus capable of controlling in such a way that uniform fixing can be performed at a high speed under stable conditions in conformity to the quality of the paper, without wrinkle or uneven gloss, even if the thickness and gloss thereof differ.

In the thermal fixing device of a color image forming apparatus, the heating roll engaged with a unfixed toner image surface must be composed of a material having an elastic layer, unlike the monochromatic image forming apparatus, as described on page 70 of the proceedings read at the 42nd seminar of the Japan Society of Electrophotography in 1996. It comprises a cylindrical cored bar of such a metal as aluminum or stainless steel coated with a heat resistant elastic layer of silicone rubber, etc. to a thickness of about 0.5 to 3 mm. In some cases, it has a thickness of 15 to 17 μm by coating a highly heat-resistant fluorine resin such as PFA and PTFE or by tube coating, in order to improve the durability and mold releasing property on the surface. As a heat source, a halogen lamp is fixed in the space inside the metallic cored bar of a heating roll to control current application, or an insulation thin film is provided inside the metallic cored bar and a resistance heating element is provided further inside to control current application. Such a configuration is known so far. In the configuration of the normal heating roll fixing device, a heating roll is installed on the upper side, and a pressure roller is installed on the lower side in many cases. When the heating roll (hereinafter referred to as "heating roll" or "upper roll") and pressure roll (hereinafter referred to as "pressure roll" or "lower roll") engaged therewith have been brought into pressure contact with each other, a nip is convex on the top as the elastic layer of the upper roller is thicker, as shown in the schematic diagram of FIG. 11(*a*), and tends to move away from the upper roll in the tangential direction of the lower roll. This is advantageous for self-stripping performance that allows separation without using any means for stripping paper forcibly from the upper roll as a heating roll. Further, nip width can be secured by the small-diameter roll as the elastic layer of the upper roll is made thicker. The above-mentioned description is disclosed in the Japanese Publication Tokkaisho No. 55-17108 and on page 38 of Fuji Xerox Technical Report No. 9 (1994). However, the thermal conductivity of silicone rubber or the like is smaller than that of metal. Accordingly, as the elastic layer of the upper roll is made thicker, thermal conduction from the heat source to the roll surface becomes poorer; with the result that thermal deterioration is caused by increased warming-up time and temperature rise at the metallic cored rod. Further, deterioration of heat conduction from the heating plate to the roll surface causes the surface temperature to be reduced when paper is passed through, and makes it difficult to increase speed. If the heating roll rubber is made thinner in an attempt to improve thermal conduction from metallic cored rod for higher speed, then the fixing nip becomes flat or convex on the bottom, as shown in FIG. 11(*b*). It winds around the upper roll as a heating roll, and cannot easily be removed. If the nip becomes convex on the bottom, self-stripping will be difficult. This makes it necessary to increase the diameter of the heating roll considerably when a required nip width is to be secured. Self-stripping is not easy, when a pressure belt is adopted as a pressure member for forming a fixing nip to secure nip width in order to ensure a high speed, as disclosed in the Japanese Publication Tokkaihei No. 5-150679 (Fuji Xerox Co., Ltd.).

Methods for solving this problem is disclosed in Japanese Publications Tokkaihei No. 8-314323, No. 10-10919, No. 10-97150, No. 11-721, No. 11-24465 and No. 11-38802. As disclosed, an external heating roll without elastic layer is brought in rotary contact with the surface of the heating roller, whereby ensuring an efficient supply of heat to the heating roll. Alternatively, a heating source is provided on the pressure roll in order to ensure that not much heat will be removed from the heating roll by the pressure roll.

However, even if many heat sources are provided, the maximum power consumption is increased if power is supplied at one time. When a heat source is provided on the pressure roll side, the pressure roll temperature must be kept low if the second surface is copied in the duplex copying mode. Otherwise, this will increase the difference of the image glossiness between the front and back. When coated paper is copied under highly humid conditions, pressure roll temperature must be kept low. Otherwise, a blister may occur, as disclosed in the Japanese Publication Tokkaihei No. 11-194647. It is difficult to switch over the preset temperature earlier using the heat source located inside the pressure roll. If the pressure roll is made into a hard roll, the set temperature can be easily switched over earlier, but the image on the first surface will be deteriorated in the duplex copying mode. This will raise a problem.

In recent years, as disclosed in the Japanese Publication Tokkai No. 2000-347454, wax of a low melting point is dispersed and mixed in toner, and the surface of the heating roll is coated with fluorine resin, whereby reduced cost, easy writing on the hardcopy, easy bonding of tape, and greater transparency of the transparent sheet are ensured, without having to use the means of coating a mold releasing agent to the heating roll, which is the conventional technique. To achieve these objects, it is important to secure a self-stripping performance, as mentioned above, and to allow the fixing nip to be formed convex on the top, as viewed from the side. However, as described in the Konica Technical Report (1997), if the upper convex shape of the nip is excessive, then wrinkles will occur at the overlapped portion of paper for example, in envelopes. To solve this problem, it has been common practice to select the conditions permitting compatibility between wrinkles of the envelope and self-stripping performance, as disclosed in the Japanese Publications Tokkaihei No. 05-265344 and Tokkai No. 2000-321913. But it has been necessary to apply several milligrams of silicone oil per page, as described in Japanese Publication Tokkai No. 2000-321913. Accordingly, in the oil-less fixing mode without mold releasing agent being applied to ensure self-stripping performance while preventing the wrinkles of an envelope, it is necessary to give effects other than nip profile.

At present, it is common practice to prepare several modes of changing a preset temperature, process speed and other factors of the heating roll and pressure roll for a great variety of paper types different in thickness, gloss and surface properties. According to the limited information of the developer, multiple modes are determined under the name of so called paper mode or gloss mode. For limited paper types, a corresponding mode is specified so that a desired fixing property and glossiness can be obtained. For other paper types, the user selects the mode manually as appropriate. Repeating trials and errors, the user selects a preferred mode. Under these circumstances, it cannot be said that the user requirements are met in a limited number of modes for a variety of paper types. Further, if the user feeds the paper whose stiffness is lower than assumed by the developer, the aforementioned self-stripping performance cannot be secured. So paper will wind round the heating roller and the machine will get faulty. This failure must be repaired by a service engineer. This problem can be solved when a separating member that forcibly removes the paper is engaged with the surface of the heating roll. However, the portion of the separating member engaged with the heating roll is likely to deteriorate to cause a defective image to be produced. Further, if too much heat is supplied to the coated paper where different materials are coated on the surface of normal paper substrate, especially in the paper such as art paper and coated paper with a great amount of coating material applied thereon, then steam generated from inside the paper substrate is hindered by the coated layer and cannot get out of paper, with the result that a blister specific to coated paper may be caused in some cases. For plain paper, it is preferred to change the fixing conditions for control. So far, change of fixing conditions has been made by manual selection of the aforementioned mode. Further, for the same paper type, fixing conditions have been changed according to the moisture content of paper and the type of copying mode (simplex or duplex copying). However, fixing conditions have not been changed according to the combination with paper qualities such as thickness, gloss or stiffness as inherent properties of paper.

SUMMARY OF THE INVENTION

The object of the present invention is to solve the aforementioned problems and to provide an image forming apparatus which ensures appropriate and uniform transmission of heat to the paper P subjected to heat fixing while being fed between the heating roll and pressure roll of a heat fixing device, without self-stripping performance being lost or undue increase needed in the power to be supplied to a heat source; wherein finished glossiness is kept uniformed without difference on the front and back, high speed fixing is permitted without an envelope being wrinkled, an image being deteriorated or a blister being produced, and there is no need of applying silicone oil to the heating roll during image formation.

Another object of the present invention is to provide an image forming apparatus that automatically meets appropriate fixing conditions in conformity to paper quality by automatic detection of the gloss, thickness and humidity of paper.

BRIEF DESCRIPTION OF THE DRAWINGS

FIGS. 9(*a*) and 9(*b*) are the drawing representing the halogen lamp operation according to the present invention;

DETAILED DESCRIPTION OF THE PREFERRED EMBODIMENT

Figure 1:
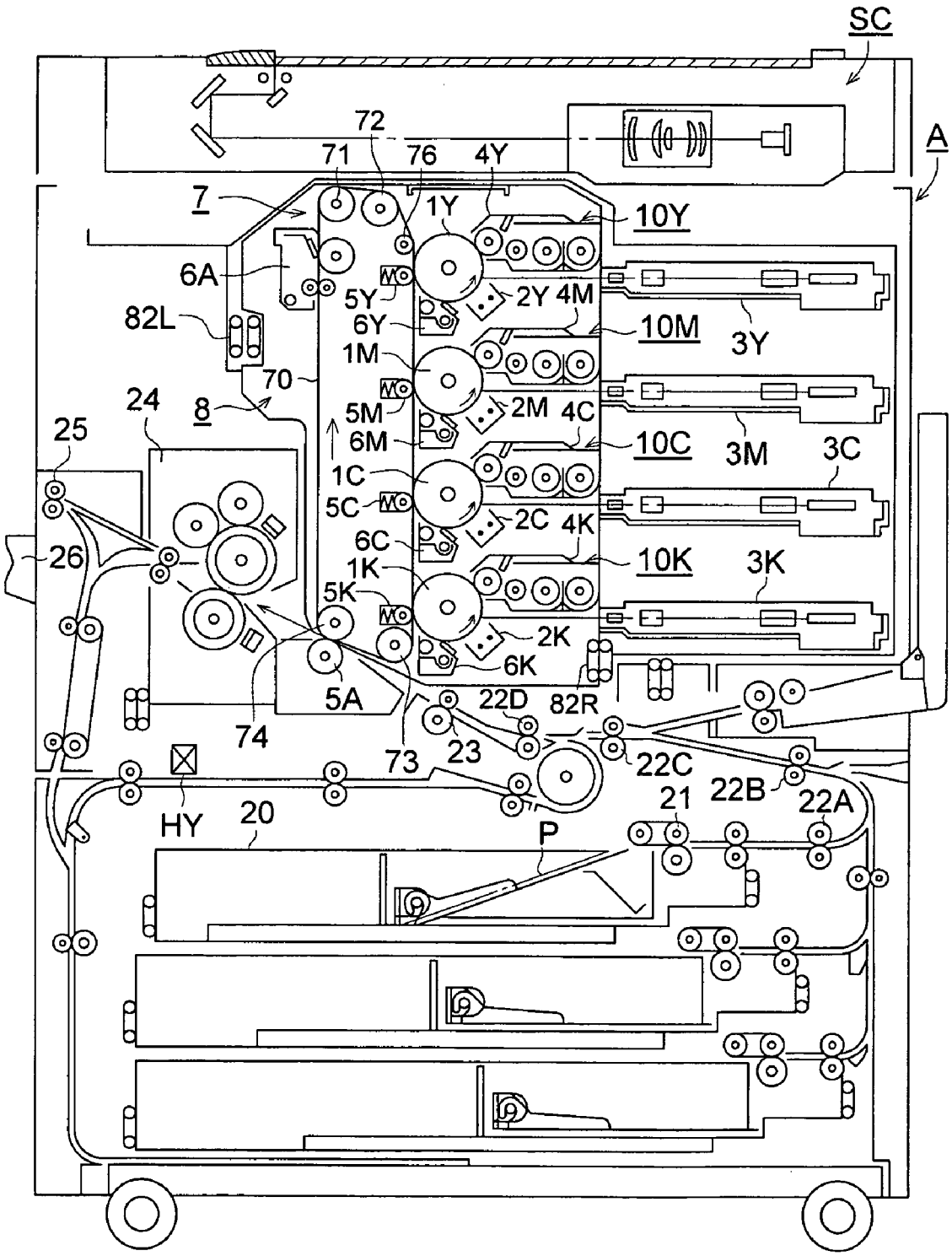
FIG. 1 is a cross sectional view of the color image forming apparatus showing one embodiment of an image forming apparatus according to the present invention.

The object of the present Invention can be achieved by any one of the following Structures (1) to (18):

(1) An image forming apparatus equipped with a heat fixing device comprising a heating roll as a heating member incorporating a heater as a heating source and having at least one elastic layer, and a pressure roll as a pressure member having at least one elastic layer whose surface is in contact with an external heating roll incorporating a heater therein, the aforementioned. image forming apparatus further characterized in that thermal conductivity of the elastic layer of the aforementioned pressure roll is smaller than that of the elastic layer of the aforementioned heating roll.

(2) An image forming apparatus according to Structure (1) characterized in that the hardness of the aforementioned heating roll does not exceed that of the aforementioned pressure roll.

(3) An image forming apparatus according to Structure (1) or (2) characterized in that the elastic layer of the aforementioned heating roll is composed of a solid silicone rubber, the elastic layer of the aforementioned pressure roll is composed of a sponge silicone rubber, and the surface of the aforementioned pressure roll is covered with a fluorine resin tube.

(4) An image forming apparatus. equipped with a heat fixing device comprising a heating roll as a heating member incorporating a heater as a heating source and having at least one elastic layer, and a pressure roll as a pressure member incorporating a heater and having at least one elastic layer whose surface is in contact with an external heating roll having a heater therein, the aforementioned image forming apparatus further characterized in that the heater inside the heating roll and the heater inside the external heating roll operate during image forming operation, and the heater inside the heating roll and the heater inside the pressure roll operate during the operations other than image forming operation.

(5) An image forming apparatus equipped with a heat fixing device comprising a heating roll as a heating member incorporating a heater as a heating source and having at least one elastic layer, an external heating roll having a heater therein which is in contact with the aforementioned heating roll and a pressure roll as a pressure member incorporating a heater and having at least one elastic layer, the aforementioned image forming apparatus further characterized in that, during image forming operation, only the heater inside the aforementioned heating roll and the heater of the external heating roll are operated without the heater inside the aforementioned pressure roll being operated, and during the operations other than image forming operation, only the heater inside the heating roll and the heater inside the pressure roll are operated, without the heater of the external heating roller being operated.

(6) An image forming apparatus equipped with a heat fixing device comprising a heating roll as a heating member incorporating a heater as a heating source and having at least one elastic layer, and a pressure roll as a pressure member having at least one elastic layer, the aforementioned image forming apparatus further characterized in that the sum or difference between the set temperature T1 of the aforementioned heating roll and the set temperature T2 of the aforementioned pressure roll is changed by detecting at least one of paper thickness, moisture, paper gloss, copy mode (either simplex copy mode or duplex copy mode).

(7) An image forming apparatus according to Structure (6) characterized by being controlled in such a way that, the greater the paper thickness, the greater the T1+T2 in the aforementioned T1 and T2, the greater the moisture being detected, the greater T1−T2, the greater the paper gloss, the greater the T1−T2, and the greater the T1−T2 as the apparatus is in the duplex copy mode.

(8) An image forming apparatus equipped with a heat fixing device comprising a heating member having a toner mold releasing layer on a substrate and a pressure member, and incorporating at least one heater as a heat source, the aforementioned image forming apparatus further characterized in that the aforementioned heating member in contact with an unfixed toner image has an elastic layer on the substrate, the aforementioned elastic layer is coated with a fluorine resin, and the aforementioned pressure member having a substrate covered with a fluorine resin tube through an elastic layer or directly.

(9) An image forming apparatus equipped with a heat fixing device comprising a heating roll as a heating member having an elastic layer on a cored bar and a toner mold releasing layer on the elastic layer and a pressure roll as a pressure member, and incorporating at least one heater as a heat source, the aforementioned image forming apparatus further characterized in that the aforementioned heating roll is manufactured by forming silicone rubber on the cored bar and coating with fluorine resin thereafter, and the aforementioned pressure roll is manufactured by coating a cored bar with silicone rubber and by covering the silicone rubber with a fluorine resin tube.

(10) An image forming apparatus according to Structure (9) further characterized in that the surface deflection of the aforementioned heating roll is almost the same as that of the aforementioned pressure roll.

(11) An image forming apparatus equipped with a heat fixing device comprising a heating roll as a heating member with an elastic layer provided on a cored bar and a toner mold releasing layer provided on the elastic layer, a pressure belt as pressure member having a toner mold releasing layer on a substrate, and at least one heater as a heat source, the aforementioned image forming apparatus further characterized in that the aforementioned heating roll is manufactured by forming a silicone rubber on the cored bar and by coating with fluorine resin thereafter, and the aforementioned pressure belt is manufactured by covering the substrate with a fluorine resin tube.

(12) An image forming apparatus equipped with a heat fixing device comprising a heating belt as a heating member with an elastic layer provided on a substrate and a toner mold-releasing layer provided on the elastic layer, a pressure roller as pressure member with an elastic layer on a cored bar and a toner mold releasing layer on the electronic layer, and at least one heater as heat source, the aforementioned image forming apparatus further characterized in that the aforementioned heating belt is manufactured by forming silicone rubber on the substrate and coating with fluorine resin thereafter, and the aforementioned pressure roller is manufactured by coating the cored bar with silicone rubber and covering the silicone rubber with a fluorine resin tube.

(13) An image forming apparatus according to any one of Structures (8) to (12) further characterized in that wax-containing toner is used without mold releasing agent applied to the aforementioned heating roll or heating belt and pressure roll or pressure belt.

(14) An image forming apparatus according to any one of Structures (8) to (13) further characterized in that an temperature sensor for detecting the surface temperature of at least the aforementioned heating roll or belt is provided without contacting the surface of the aforementioned heating roll or belt surface in the vicinity of an image forming area, or in contact with the surface of the aforementioned heating roll or belt surface outside the image forming area, and a member for separating and guiding a transfer material from the heating roller or belt is provided without contacting the surface of the heating roll or belt.

(15) An image forming apparatus equipped with a heat fixing device comprising a heating roll incorporating a cylindrical cored bar with a heater as heat source, an elastic body provided around the aforementioned cored bar, and a mold releasing layer for covering the aforementioned elastic body, and a pressure roll as heating member brought into pressure contact with this heating roll, wherein the aforementioned transfer material is fixed in place by heating and pressing by means of a pressure-welded fixing nip, whereby toner image is fixed in place, the aforementioned image forming apparatus further characterized in that a gloss sensor is provided in the paper feed path to sense the gloss of a transfer material, and fixing conditions are controlled according to the reading of the aforementioned gloss sensor.

(16) An image forming apparatus according to Structure (15) further characterized in that fixing conditions are controlled according to the reading of a humidity sensor provided inside or outside the aforementioned image forming apparatus and the reading of the aforementioned gloss sensor.

(17) An image forming apparatus equipped with a heat fixing device comprising a heating roll incorporating a cylindrical cored, bar with a heater as heat source, an elastic body provided around the aforementioned cored bar, and a mold releasing layer for covering the aforementioned elastic body, and a pressure roll as heating member brought into pressure contact with this heating roll, wherein the aforementioned transfer material is fixed in place by heating and pressing by means of a pressure-welded fixing nip, whereby toner image on the transfer material is fixed in place, the aforementioned image forming apparatus further characterized in that a stiffness sensor whose reading changes according to the stiffness of the transfer material is provided on the paper feed path, and the processing speed of the fixing device is controlled by the reading of the aforementioned stiffness sensor.

(18) An image forming apparatus according to any one of Structures (15) to (17) further characterized in that the aforementioned gloss sensor also serves as the aforementioned stiffness sensor.

The following describes the embodiments of the present invention. The assertive statements regarding the embodiments of the present invention indicate the best mode. They do not restrict the meaning of the terminologies of the present invention or the technological scope.

FIG. 1 is a cross sectional view of the color image forming apparatus showing one embodiment of an image forming apparatus according to the present invention.

This color image forming apparatus is called a tandem type color image forming apparatus, and has multiple sets of image forming units 10Y, 10M, 10C and 10K, an endless transfer belt unit 7, paper feed means and heat fixing device 24. A document readout apparatus SC is installed on the top of the main unit A of the image forming apparatus.

The image forming unit 10Y forming an yellow image has charging means, arranged around a drum-shaped photoconductor 1Y as a first image carrier, exposure means 4Y, developing means 4Y, a primary transfer roll 5Y as primary trans means, and cleaning means 6Y. The image forming unit 10M for forming a magenta image has a drum-shaped photoconductor 1M as a first image carrier, charging means 2M, exposure means 3M, developing means 4M, a primary transfer roll 5M as primary transfer means, and cleaning means 6M. The image forming apparatus 10C for forming a cyan image has a drum-shaped photoconductor 1C as a first image carrier, charging means 2C, exposure means 3C, developing means 4C, primary transfer roll 5C as primary transfer means, and cleaning means 6C. The image forming apparatus 10K for forming a black image has a drum-shaped photoconductor 1K as a first image carrier, charging means 2K, exposure means 3K, developing means 4K, a primary transfer roll 5K as primary transfer means and cleaning means 6K.

The endless transfer belt unit 70 has an endless transfer belt 70 as a second semiconducting endless belt-shaped image carrier wound and rotatably supported by multiple rolls 71, 72, 73, 74 and 76, and supported.

Images formed by the image forming units 10Y, 10M, 10C and 10K are sequentially transferred onto the endless transfer belt 70 rotated by the primary transfer rolls 5Y, 5M, 5C and 5K, whereby a synthesized color image is formed. Paper P as a transfer material (transfer material is hereafter called paper P) that is a recording medium stored inside a paper feed cassette 20 is fed by paper feed means 21, and is sent to the secondary transfer means 5A via multiple intermediate rolls 22A, 22B, 22C and 22D and a resist roll 23, whereby the color image is transferred on paper P in one operation. The paper P where the color image has been transferred is subjected to fixing process by a heat fixing device 24, and is gripped by an ejection roll 25. Then it is placed on the ejection tray 26 outside the apparatus.

Cleaning means 6A removes residual toner from the endless transfer belt 70 having curve-separated paper P after color image has been transferred onto secondary transfer means 5A.

During image formation process, the primary transfer roll 5K is always kept in pressure contact with photoconductor 1K. Other primary transfer rolls 5Y, 5M and 5C are kept in pressure contact with respective corresponding photoconductors 1Y, 1M and 1C only during color image formation.

The secondary transfer means 5A is in pressure contact with endless transfer belt 70 only when paper P passes and secondary transfer is performed.

The following describes the embodiments of the heat fixing device 24 built in the image forming apparatus of the present invention:

The following embodiments have been studied at a fixing process speed of 150 to 220 mm/sec, and a copy speed of 30 to 50 sheets (A4 paper) where the maximum amount of toner deposited is about 1.2 mg/cm$^2$. Embodiments 4 and 8 include the conditions for obtaining the optimum image, without the process speed and copy speed being restricted to the aforementioned. Silicone oil was applied using a roll coated with oil impregnated with 100 cs of dimethyl silicone oil.

(Embodiment 1)

Figure 2:
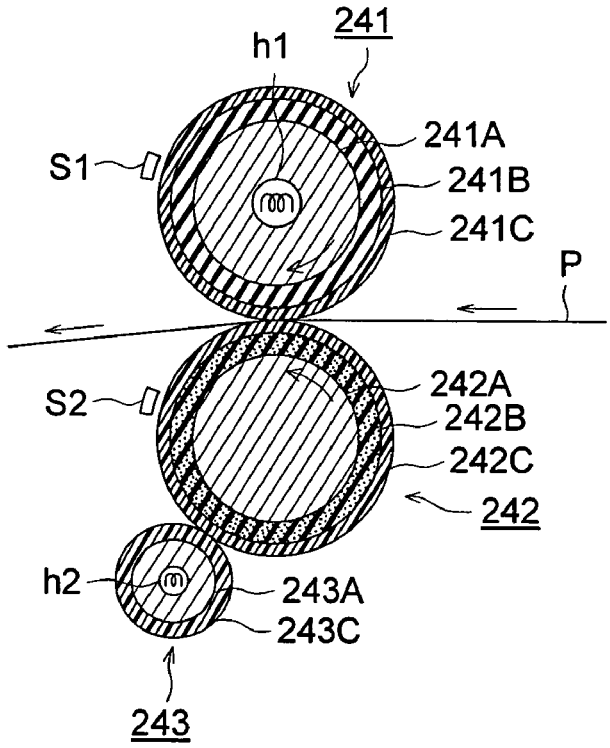
FIGS. 2(*a*) and 2(*b*) are schematic drawings representing the configuration of an example of the heat fixing device according to the present invention.
Figure 2:
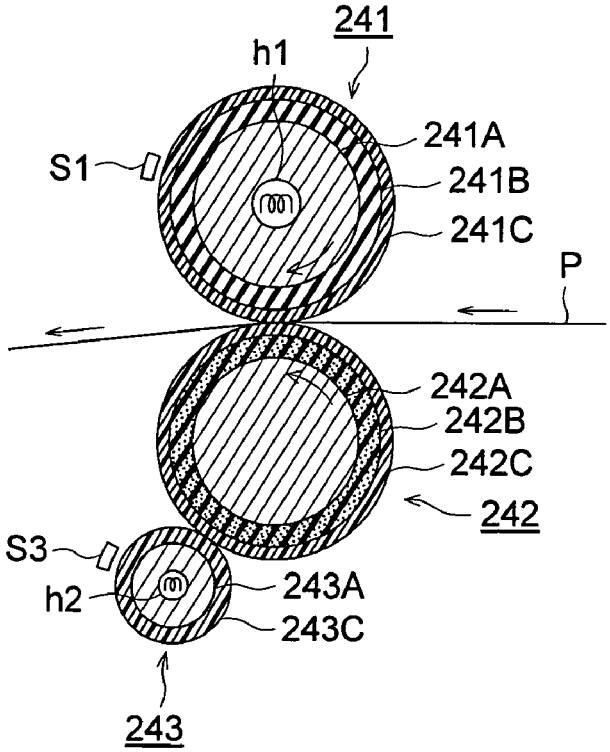

As shown in the schematic diagram of FIGS. 2(*a*) and 2(*b*), a heating roll 241 has an outer diameter of 50 mm, and solid silicone rubber (rubber hardness: 30°, on the Asker-C scale, heat conductivity: (4.2 to 5.04)×10$^{-1}$ W/m·° C.) is lined onto aluminum cored bar 241A as an elastic layer 241B to a thickness of 2 mm. As the surface layer 241C, PFA is coated on the rubber to a thickness of 30 μm through an adhesive layer. Further, the inner surface of cored bar 241A is coated with a black heat-resistant paint.

The pressure roll 242 has an outer diameter of 50 mm, and sponge silicone rubber (rubber hardness: 40°, on the Asker-C scale, heat conductivity: (0.21 to 1.26)×10$^{-1}$ W/m·° C.) is lined onto aluminum cored bar 242A as an elastic layer 242B to a thickness of 2 mm. The surface 242C is covered with a PFA tube to a thickness of 30 μm. In this case, the thickness of the fluorine resin layer on the surface layer is on almost the same level as that of the heating roll, and the hardness of the silicone rubber of the elastic layer is greater than of the heating roll. So the hardness of the product is greater than that of the heating roll 241.

An external heating roll 243 has an outer diameter of 25 mm. Using PFA, the surface layer 243C was coated on the aluminum cored bar 243A through an adhesive layer to a thickness of 30 μm. The inner surface of the cored bar 243A is coated with black heat-resistant paint. This external heating roll 243 is engaged with the pressure roll 242.

Toner is of ester wax dispersion type. It was made of St-Ac resin as the major component processed by polymerization. Application of silicone oil was tried in two different cases: in one case, about 0.5 mg of silicone oil was applied to each sheet of A4 paper, and in the other case, no oil was coated at all.

As a heater for providing heat, a halogen lamp h1 is installed inside the heating roll 241, and a halogen lamp h2 is installed inside the external heating roll 243.

A non-contact type temperature sensor S1 is provided close to the surface of the heating roll 241, and the halogen lamp h1 is controlled by the temperature detected by this sensor. A temperature sensor S3 in contact with the external heating roll 243 is provided as shown in FIG. 2(*b*). Alternatively, a non-contact type temperature sensor S2 is provided close to the surface of the pressure roll 242, as shown in FIG. 2(*a*), and the halogen lamp h2 is controlled by the temperature detected by this sensor.

As described above, the elastic layer of the pressure roll 242 is made of the material having poorer heat conductivity than the heating roll 241, and the external heating roll 243 is engaged with the surface, thereby ensuring quick temperature control with respect to the pressure roll 242, facilitating change of temperature in response to copy mode or detected temperature, and meeting the high speed requirements. Further, since the elastic layer of the pressure roll has a low conductivity, the calorific value lost from the heating roll can be reduced, and the reduction of temperature on the surface of the heating roll can be kept in check, thereby meeting high speed requirements. The elastic layer of the pressure roll 242 is made of sponge rubber, and this allows heat conductivity to be reduced to ⅓ to 1/10 of that of the solid rubber whose base material is almost the same. It also allows the heat capacity to be reduced, and this means effective configuration. Further, if the solid rubber of the heating roll 241 is set to about 40° or less on the Asker-C scale, then the fixing nip can be made convex on the top even if the elastic layer of the pressure roll 242 is made of sponge rubber. This ensures self-stripping performance. When the elastic layer of the pressure roll 242 is made of sponge rubber, the surface irregularities will be increased if the mold. This will raise a problem. To solve this problem in this case, it is preferred to cover the surface with a PFA tube as a mold releasing layer on the surface. This configuration does not require undue hardness of the pressure roll, so wrinkles did not occur to the envelope.

Almost no difference was observed when a slight amount of silicone oil was applied as described above, and when no silicone oil was applied at all. Satisfactory results could be obtained in both cases.

(Embodiment 2)

Figure 3:
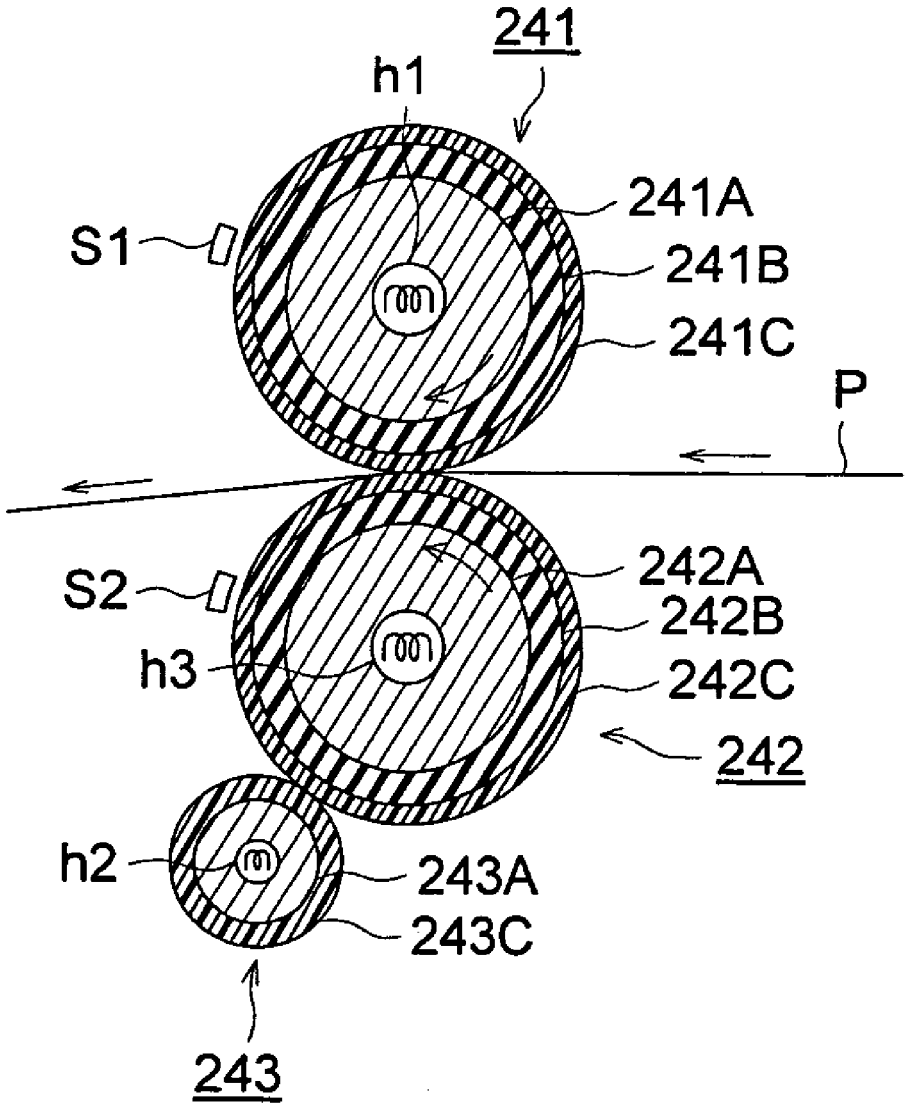
FIG. 3 is a schematic drawing representing the configuration of another example of the heat fixing device according to the present invention.

As shown in the schematic drawing of FIG. 3, a heating roll 241 has an outer diameter of 50 mm, and solid silicone rubber (rubber hardness: 30°, on the Asker-C scale, heat conductivity: (4.2 to 5.04)×$10^{-1}$ W/m·° C.) is lined onto aluminum cored bar 241A as an elastic layer 241B by a thickness of 2 mm. As the surface layer 241C, PFA is coated on the rubber to a thickness of 30 μm through an adhesive layer. Further, the inner surface of cored bar 241 is coated with a black heat-resistant paint.

The pressure roll 242 has an outer diameter of 50 mm, and sponge silicone rubber (rubber hardness: 40°, on the Asker-C scale, heat conductivity: 2.52×$10^{-1}$ W/m·° C.) is lined onto aluminum cored bar 242A as an elastic layer 242B by a thickness of 2 mm. The surface 242C is coated with PFA to a thickness of 30 μm. Further, the inner surface of cored bar 241A is coated with a black heat-resistant paint.

An external heating roll 243 has an outer diameter of 25 mm. The aluminum cored bar 243A is coated with PFA so that the surface layer 243C has a thickness of 30 μm above the rubber through an adhesive layer. The inner surface of the red bar 243A is coated with black heat-resistant paint. This external heating roll 243 is engaged with the pressure roll 242.

Toner is of ester wax dispersion type. It was made of St-Ac resin as the major component processed by polymerization.

As a heater for providing heat, a halogen lamp h1 is installed inside the heating roll 241, a halogen lamp h2 inside the external heating roll 243, and a halogen lamp h3 inside the pressure roll 242.

A non-contact type temperature sensor S1 is provided close to the surface of the heating roll 241, and the halogen lamp h1 is controlled by the temperature detected by this sensor. A non-contact type temperature sensor S2 is provided close to the surface of the pressure roll 242, and the halogen lamps h1 and h2 are controlled by the temperature detected by this sensor.

As shown in FIG. 9(*a*) representing the halogen operation, only the halogens h1 and h3 are placed under ON/OFF control when an image is not formed such as in the warm-up mode or stand-by mode. In the image formation mode, only the halogen lamps h1 and h2 are placed under ON/OFF control.

As described above, the pressure roll is warmed from inside the pressure roll 242 when an image is not formed, and from outside the pressure roll 242 when an image is formed, thereby the pressure roll 242 including the interior can be warmed uniformly up to the preferred temperature when no image is formed, and the temperature control of the pressure roll 242 can be changed in the image formation mode. It is also possible to reduce the maximum power consumption. Further, the solid rubber of the heating roll 241 is set at a level softer than the pressure roll 242 on the Asker-C scale, so the fixing nip can be formed convex on the top, and self-stripping performance can be ensured.

(Embodiment 3)

Figure 4:
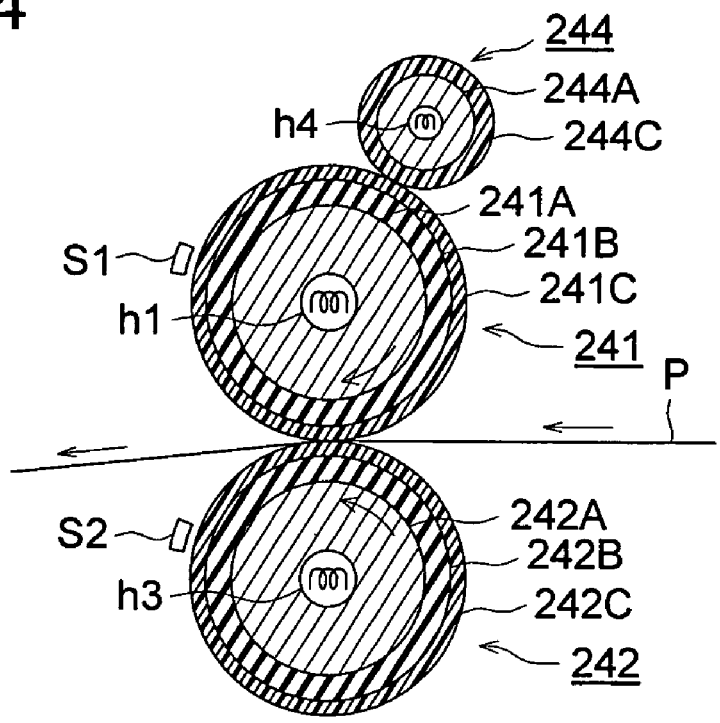
FIG. 4 is a schematic drawing representing the configuration of still another example of the heat fixing device according to the present invention.

As shown in the schematic diagram of FIG. 4, a heating roll 241 has an outer diameter of 50 mm, and solid silicone rubber (rubber hardness: 30°, on the Asker-C scale, heat conductivity: (4.2 to 5.04)×$10^{-1}$ W/m·° C.) is lined onto aluminum cored bar 241A as an elastic layer 241B to a thickness of 2 mm. As the surface layer 241C, PFA is coated on the rubber to a thickness of 30 μm through an adhesive layer. Further, the inner surface of cored bar 241A is coated with a black heat-resistant paint.

The pressure roll 242 has an outer diameter of 50 mm, and solid silicone rubber (rubber hardness: 40°, on the Asker-C scale, heat conductivity: (2.52 to 5.04)×$10^{-1}$ W/m·° C.) is lined onto aluminum cored bar 242A as an elastic layer 242B to a thickness of 2 mm. The surface 242C is covered with a PFA tube to a thickness of 30 μm above the rubber. Further, the inner surface of the cored bar is coated with a black heat-resistant paint.

An external heating roll 244 has an outer diameter of 25 mm. The aluminum cored bar 244A is coated with PFA so that the surface layer 244C has a thickness of 30 μm above the rubber through an adhesive layer. The inner surface of the red bar 244A is coated with black heat-resistant paint. This external heating roll 244 is engaged with the heating roll 241.

Toner is of ester wax dispersion type. It was made of St-Ac resin as the major component processed by polymerization.

As a heater for providing heat, a halogen lamp h1 is installed inside the heating roll 241, a halogen lamp h4 inside the external heating roll 244, and a halogen lamp h3 inside the pressure roll 242.

A non-contact type temperature sensor S1 is provided close to the surface of the heating roll 241, and the halogen lamps h1 and h4 are controlled by the temperature detected by this sensor. A non-contact type temperature sensor S2 is provided close to the surface of the pressure roll 242, and the halogen lamp h3 is controlled by the temperature detected by this sensor.

As shown in FIG. 9(*b*) representing the halogen operation, only the halogens h1 and h3 are placed under ON/OFF control when an image is not formed such as in the warm-up mode or stand-by mode. In the image formation mode, only the halogen lamps h1 and h4 are placed under ON/OFF control.

As described above, the heating roll 241 is warmed from inside the heating roll 241 and pressure roll 242 when an image is not formed, and from outside the heating roll 241 when an image is formed, thereby the pressure roll 242 including the interior can be warmed uniformly up to preferred temperature when no image is formed and, in the image formation mode, it is possible to reduce the maximum power consumption by supplying the heating roll 241 with the maximum consumption power greater than in the non-image formation mode. It is possible to minimize the reduction of temperature on the surface of the heating roll 241 within the limited maximum consumption power, thereby meeting the high speed requirements. Further, the solid rubber of the heating roll 241 is set at a level softer than the pressure roll 242 on the Asker-C scale, so the fixing nip can be formed convex on the top, and self-stripping performance can be ensured.

(Embodiment 4)

Figure 8:
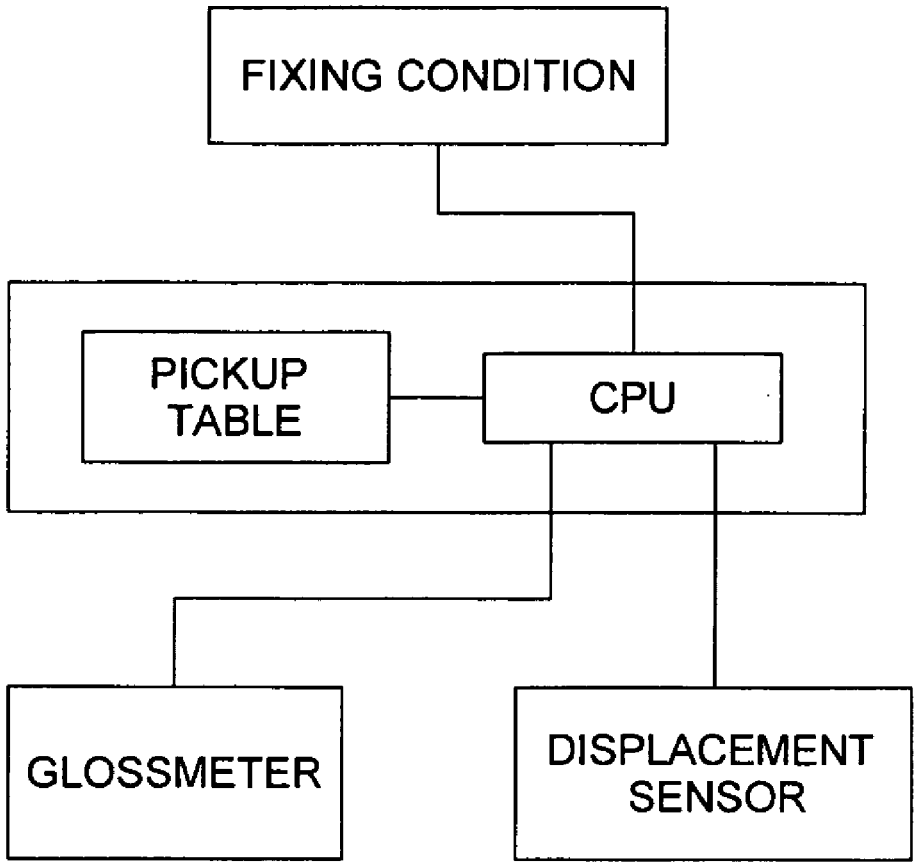
FIG. 8 is a drawing representing the circuit diagram for controlling the fixing conditions according to paper quality in a heat fixing device according to the present invention.

Paper thickness is input by the user by means of the dial of a paper feed cassette or the like. The humidity around the paper feed position is detected or estimated by a commercially available humidity sensor provided inside the image forming apparatus, and the gloss sensor located in the paper feed unit or paper passage is used to determine if the paper is coated or not. The type of coated paper is determined according to the reading of the gloss sensor, and the apparatus determines if the user has selected the simplex or duplex copy mode. Based on this information, the set temperature T1 of the heating roll and set temperature T2 of the pressure roll are set up. If it has been determined that the change of the set temperatures of the heating and pressure rolls alone are not sufficient to ensure a satisfactory image, then the fixing process speed and copying speed are controlled. The set values are formulated in a Table. As shown in the circuit diagram of FIG. 8, they are input in the controller in advance. Namely, T1 and T2 ensuring the optimum fixing operation can be set by Increasing or decreasing the T1+T2 and T1−T2 by comparison with the aforementioned tabulated data, depending on paper quality such as humidity and gloss, and the copy mode (simple or duplex copy mode).

Such a configuration provides a desirable and stable glossy color image meeting the requirements of the paper gloss level with a sufficient amount of toner fixed in place, without any blister being caused to occur, despite changes in the type of paper, humidity or copy mode.

(Embodiment 5)

Figure 5:
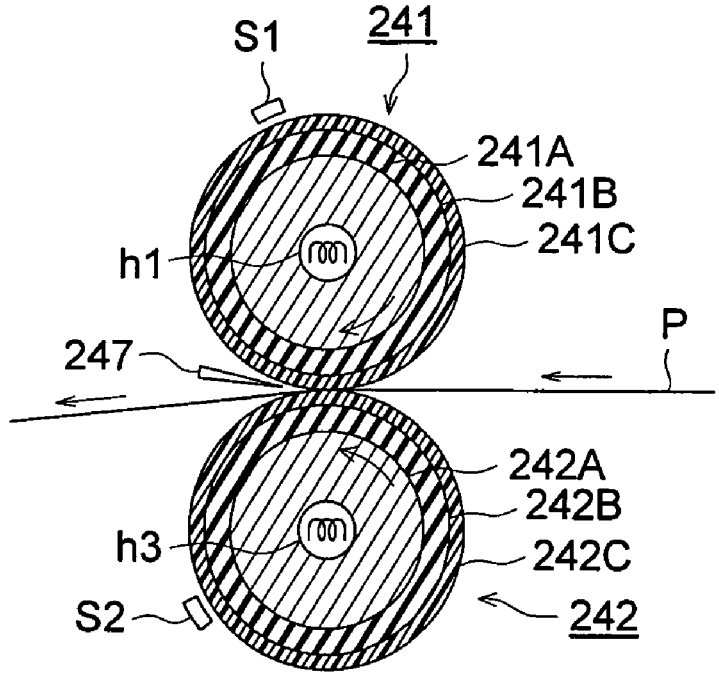
FIG. 5 is a schematic drawing representing the configuration of a further example of the heat fixing device according to the present invention.

As shown in the schematic drawing of FIG. 5, a heating roll 241 has an outer diameter of 50 mm, and solid silicone rubber (rubber hardness: 30°, on the Asker-C scale, heat conductivity: (4.2 to 5.04)×$10^{-1}$ W/m·° C.) is lined onto aluminum cored bar 241A as an elastic layer 241B by a thickness of 2 mm. As the surface layer 241C, PFA is coated on the rubber to a thickness of 30 μm through an adhesive layer. The surface roughness Rz is within the range from 1 to 5 μm. After application of coating agent and burning, the surface is provided with grinding or other treatment, thereby ensuring a desired surface roughness.

The pressure roll 242 has an outer diameter of 50 mm, and silicone rubber (rubber hardness: 30°, on the Asker-C scale, heat conductivity: (4.2 to 5.04)×$10^{-1}$ W/m·° C.) is lined onto aluminum cored bar 242A as an elastic layer 242B by a thickness of 2 mm. The surface 242C is covered with PFA tube to a thickness of 30 μm. In this case, the surface roughness Rz is 0.8 μm or smaller.

Toner is made of St-Ac polymer of ester wax dispersion type as the major component processed by polymerization. No silicone oil is applied at all.

Temperature sensors S1 and S2 are installed as follows: Non-contact type radiation heat detection type sensors are provided on the heating roll and pressure roll. Alternatively, contact type thermister sensors are provided at no-paper feed portions of rolls. Halogen lamps h1 and h3 are installed inside the heating roll 241 and pressure roll 242.

A separating member 247 is provided by installing a PTFE-coated baffle plate close to the paper feed route near the fixing unit outlet in a non-contact state. Since the temperature sensor or separating member are not in contact with the surface of the roll in the image area, the surface of the roll is not damaged or worn, whereby possible deterioration of an image can be prevented.

When the above-mentioned configuration is adopted, the surface roughness of the heating roll 241 coated with fluorine resin on the surface is greater than that of the pressure roll 245C covered with a fluorine resin tube on the surface. This allows contact with the paper and toner image to be loosened, and provides satisfactory self-stripping performance. At the same time, this reduces the surface roughness of the pressure roll covered with fluorine resin tube, and improves the contact with paper, with the result that paper is less frequently caught by the heating roll, and self-stripping performance is improved. When this configuration is employed, the hardness of the heating roll is almost the same as that of the pressure roll (since the silicone rubber has the same hardness), and the fixing nip is almost flat. Despite that, the self-stripping performance can be ensured even without silicone oil being applied. The fixing nip is flat and the self-stripping performance is ensured. This means that the performance of reducing wrinkles of an envelope is superior to that in Embodiment 2.

(Embodiment 6)

Figure 6:
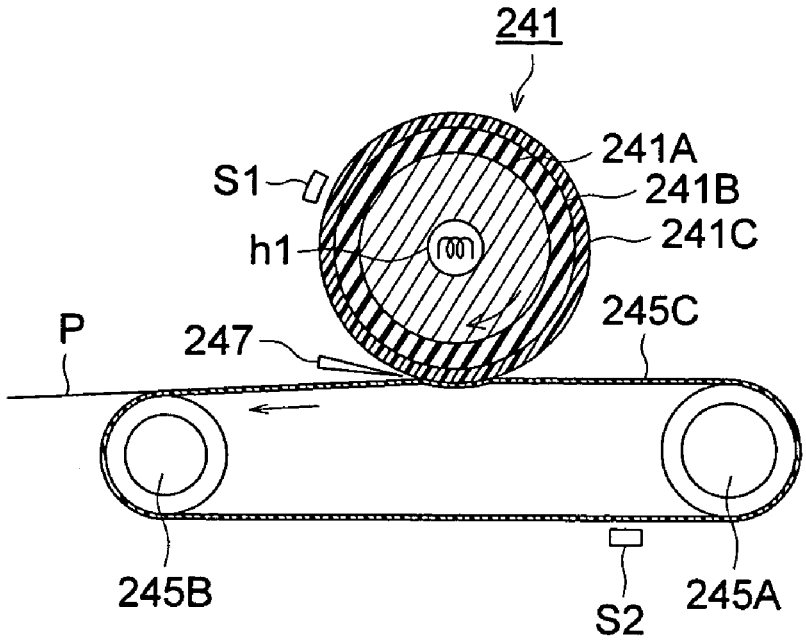
FIG. 6 is a schematic drawing representing the configuration of another example of the heat fixing device according to the present invention.

As shown in the schematic drawing of FIG. 6, a heating roll 241 has an outer diameter of 50 mm, and silicone rubber (rubber hardness: 30°, on the Asker-C scale, heat conductivity: (4.2 to 5.04)×$10^{-1}$ W/m·° C.) is lined onto aluminum cored bar 241A as an elastic layer 241B by a thickness of 1 mm. PFA is coated on the silicon rubber to a thickness of 30 μm through an adhesive layer. The surface roughness Rz is within the range from 1 to 5 μm. After application of coating agent and burning, the surface is provided with grinding or other treatment, thereby ensuring a desired surface roughness.

The pressure belt 245C is made of seamless polyimide (PI) as the major component, and its surface layer is covered with a PFA tube having a thickness of 30 μm. The surface roughness Rz is 0.8 μm or smaller.

As shown in the schematic diagram of FIG. 6, the pressure belt 245C tensioning structure and the pressure belt 245C back up structure at the fixing nip are configured in such a way that these belts are applied to the drive roll 245A Also serving as a guider roll and a driven roll 245B in an endless manner. The nip portions of the heating roller and pressure belt may be equipped with a stationary pressure member that provides backup from the back side of the pressure belt.

Toner is made of St-Ac polymer of ester wax dispersion type as the major component processed by polymerization. No silicone oil is applied at all.

As the temperature sensors S1 and S2, non-contact type radiation heat detection type sensors or contact type thermister sensors (where paper is not fed) are installed, as described above. A halogen lamp h1 is installed inside the heating roll 241.

As shown in FIG. 6, a separating member 247 is provided with the PTF-coated baffle plate. When the above-mentioned configuration is adopted, the surface roughness of the heating roll 241 coated with fluorine resin on the surface is greater than that of the pressure roll 245C covered with a fluorine resin tube on the surface. This allows contact with the paper and toner image to be loosened, and provides satisfactory self-stripping performance. At the same time, this reduces the surface roughness of the pressure roll covered with fluorine resin tube, and improves the contact with paper, with the result that paper is less frequently caught by the heating roll, and self-stripping performance is improved. When this configuration is employed, satisfactory self-stripping performance is ensured even if the fixing nip is convex on the bottom and only a small amount of oil (0.5 mg for each sheet of A4-sized paper) is applied. Even when no oil is applied at all, satisfactory self-stripping performance is ensured if the paper thickness and stiffness are equal to or greater than a predetermined level.

(Embodiment 7)

Figure 7:
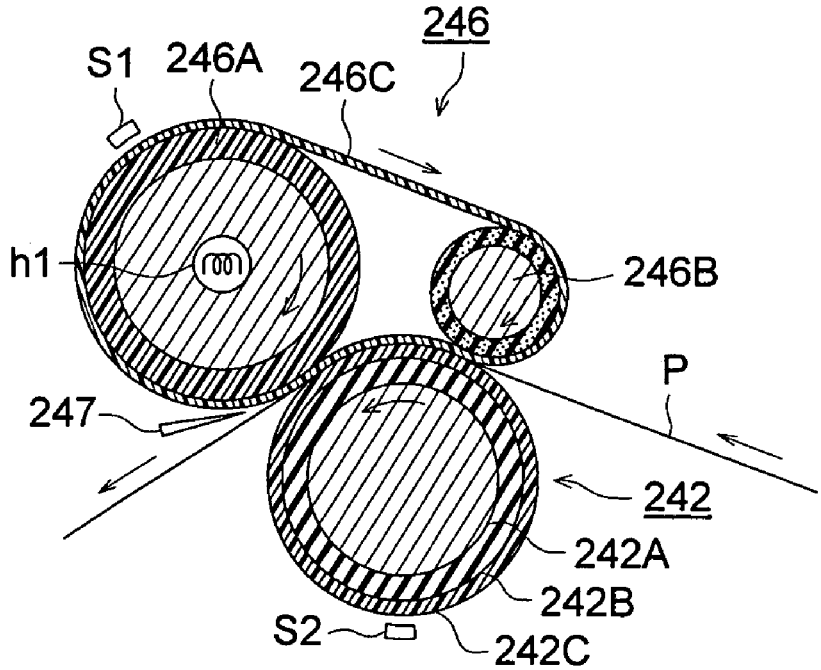
FIG. 7 is a schematic drawing representing the configuration of a still further example of the heat fixing device according to the present invention.

As shown in the schematic diagram of FIG. 7, the heating belt 246C is made of seamless polyimide (PI) as the major component with silicon rubber having a thickness of 0.2 mm, and the surface layer is coated with a PFA to a thickness of 30 μm. The surface roughness Rz is within the range from 1 to 5 μm.

The pressure roll 242 has an outer diameter of 30 mm, and silicone rubber (rubber hardness: C 30°, on the Asker-C scale) is lined onto aluminum cored bar 242A as an elastic layer 242B to a thickness of 3 mm. The surface 242C is covered with a PFA tube to a thickness of 30 μm. The surface roughness Rz is 0.8 micron or smaller.

The heating roll 246A has an outer diameter of 30 mm, and PTFE is coated onto aluminum cored bar to a thickness of 20 μm as surface layer.

An auxiliary roll 246B has an outer diameter of 20 mm. Silicone sponge rubber is applied onto the aluminum cored bar to a thickness of 3 mm, and the surface layer is covered with PFA tube to a thickness of 30 μm.

Toner is made of St-Ac polymer of ester wax dispersion type as the major component processed by polymerization. No silicone oil is applied at all.

As the temperature sensors S1 and S2, non-contact type radiation heat detection type sensors or contact type thermister sensors (where paper is not fed) are installed, as described above. A halogen lamp h1 is installed inside the heating roll 246A.

A separating member 247 is provided with the PTFE-coated baffle plate. It is provided close to the outlet of a heat fixing device 24 without contacting it.

Conventionally, in the fixing of heating belt, the backup roll of the fixing nip forming unit is a soft roll in order to ensure self-stripping performance. In this case, efficiency has been poor even when a heat source is provided inside. By contrast, the configuration of the present invention allows the surface of the heating belt to be designed to provide satisfactory self-stripping performance, with the result that a greater freedom is given to the shape of a fixing nip. It allows a hard roll to be used as a backup roll, and permits a heat source to be installed inside, whereby the efficiency of heat transmission to the heating belt is improved. When the above-mentioned configuration is adopted, the surface roughness of the heating belt coated with fluorine resin on the surface is greater than that of the pressure roll covered with a fluorine resin tube on the surface. This allows contact with the paper and toner image to be loosened, and provides satisfactory self-stripping performance. At the same time, this reduces the surface roughness of the pressure roll covered with fluorine resin tube, and improves the contact with paper, with the result that paper is less frequently caught by the heating belt, and self-stripping performance is improved. When this configuration is employed, satisfactory self-stripping performance is ensured even if silicone oil is not applied.

(Embodiment 8)

Toner is made of St-Ac polymer of ester wax dispersion type as the major component processed by polymerization.

Figure 10:
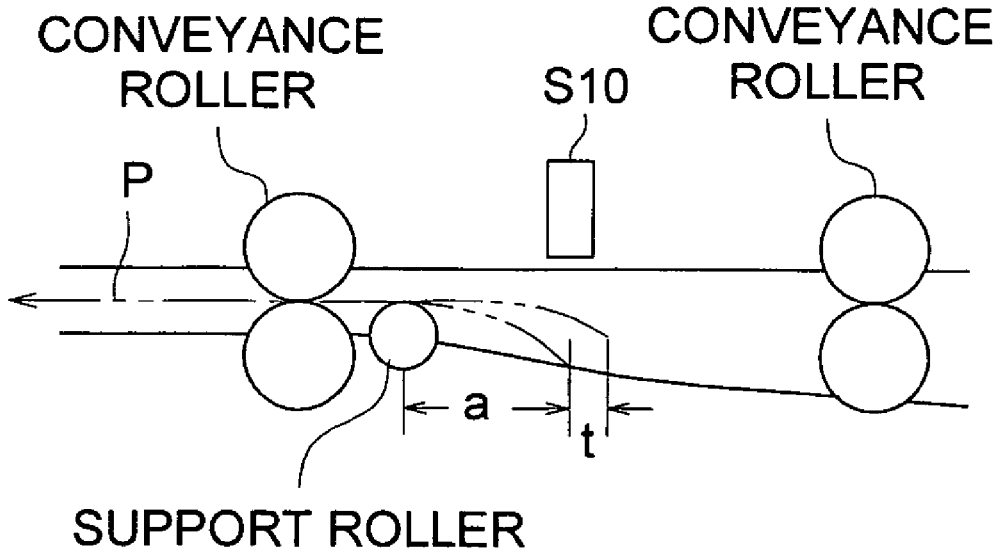
FIG. 10 is side view representing a reflected light intensity sensor installed in a feed path.
Figure 11:
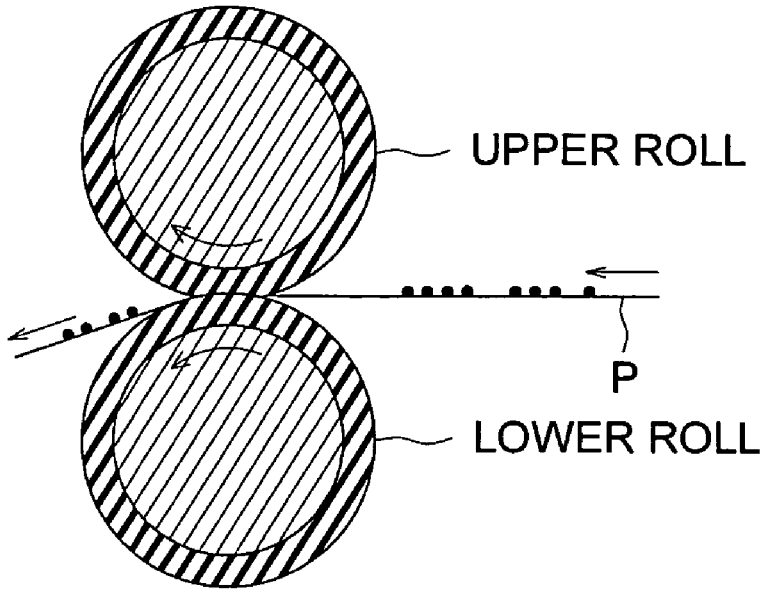
FIG. 11 (a) PRIOR ART
FIGS. 11(*a*) and 11(*b*) are the schematic drawings representing the status of nipping between a heating roll and a pressure roll.
Figure 11:
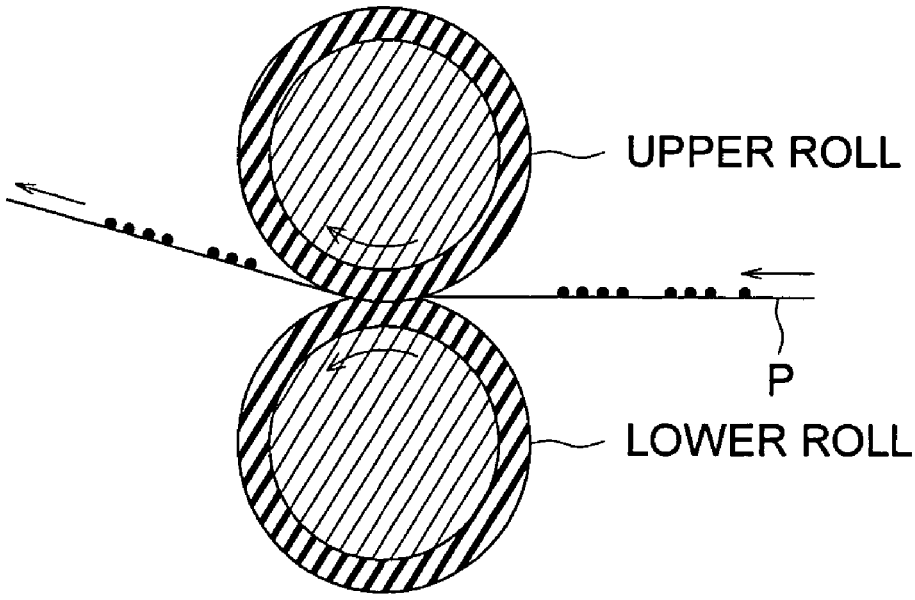
FIG. 11 (b) PRIOR ART

A heat fixing device as described in the Embodiments 1 to 3 and 5 to 7 are incorporated into the image forming apparatus of the present invention. On the paper path are installed a gloss sensor for detecting the amount of light reflected by paper P and a stiffness sensor for detecting stiffness by detecting at a standstill the amount of deflection at the top end or rear end a certain distance away from the fixed end of paper in the horizontal direction. At the same time, a humid sensor HY is installed inside and outside the image forming apparatus, and detection data thereof is input into a controller to perform control shown in the circuit diagram of FIG. 8 and to perform control of temperatures T1 and T2 and linear speed control. Through this procedure, it has been verified that satisfactory fixing with uniform gloss can be ensured despite high speed operation and changing paper quality. As shown in the side view of FIG. 10, a reflected light intensity sensor S10 is used to detect the amount of light when the amount of reflected light is the maximum as glossiness of the paper; and at the same time, the duration of time from that time to the time when the reading of the reflected light intensity sensor S10 becomes zero is measured, whereby the stiffness of the paper is detected according to the resulting difference. When such a reflected light intensity sensor is used, it can serve as the gloss sensor or the stiffness sensor.

Automatic control is performed to ensure the fixing conditions where the reading of the gloss sensor is converted into the amount of coating on the coated layer of the paper and the gloss of paper; the stiffness of paper is estimated from the reading of the stiffness sensor; and fixing separation performance can be secured according to the amount of coating, gloss and stiffness of paper with the result that the gloss very close to that of paper is obtained on the image, without any blister occurring even to the coated paper. It is preferred that the relationship between the gloss of paper and that on the image can be changed as desired by a user.

The aforementioned configuration has made it possible to predict the amount of coating on paper from paper gloss, to perform automatic control of the mode, to minimize the occurrence of blister on paper, to predict thickness of paper from paper stiffness, and to carry out automatic detection of a highly efficient effective linear speed for improved productivity, thereby ensuring stable and satisfactorily fixed images on a continuous basis.

Self-tripping performance has been improved by determining the difference in the hardness on the surfaces of the heating member and pressure member in image forming apparatus of the present invention equipped with a heat fixing device, and the difference in the surface roughness thereof.

Determining the difference in the thermal conductivities of the heating member and pressure member has allowed a gloss meter and a displacement sensor to be installed for automatic determination of the temperatures on the surfaces of the heating member and pressure member in response to the changes in paper gloss and thickness, thereby ensuring quick switching.

Further, the maximum power consumption can be reduced by switching between the ON/OFF statuses of the operations of the heat sources for the heating member, pressure member and external heating roll in image formation mode and other standby mode.

The present invention ensures reduced costs, easy writing on the hardcopy, easy bonding of tape, greater OHT transparency under the conditions of using was-containing toner, without having to apply silicone oil.

The present invention also provides appropriate gloss for the paper with much coating thereon, and minimizes blister.

It also provides appropriate gloss in the process of fixing on art paper and coated paper required on the POD market. Appropriate gloss is obtained for various types of paper, and operation can be performed by accurate automatic detection, without depending on mode setting by a user.

When fluorine resin is coated on the surface of such a heating member as a heating roll or heating belt and a temperature sensor or separation pawl is brought in contact, only the contacted portion on the surface of the heating roll is generally worn, resulting in smaller surface roughness and partial gloss irregularities. To eliminate this possibility, a temperature sensor and separation guide member are installed on the surfaces of the heating roll or heating belt without contacting with each other. This is very effective in avoiding gloss irregularities.

What is claimed is:

1. An image forming apparatus provided with a heat fixing device comprising:

(a) a heating member having an elastic layer on a substrate and a fluorine resin coated on the elastic layer, as a toner releasing layer, the heating member being in contact with an unfixed toner image;

(b) a pressure member having a substrate covered with a fluorine resin tube through an elastic layer or without the elastic layer, which is in pressure contact with the heating member; and (c) at least one heater as a heat source, provided inside either the heating member or the pressure member, wherein surface roughness of the fluorine resin of the heating member is greater than the surface roughness of the fluorine resin tube of the pressure member.

2. The image forming apparatus of claim 1, wherein each of the heating member and the pressure member has a roll shape, the pressure member has said elastic layer, and the elastic layer of each of the heating member and the pressure member is made of a silicone rubber.

3. The image forming apparatus of claim 2, wherein an amount of surface deflection of the heating roll is almost the same as that of the pressure roll.

4. The image forming apparatus of claim 1, wherein the heating member has a roll shape and the pressure member has a belt shape, and wherein the heating roll is manufactured by forming a silicone rubber on the substrate and by coating with fluorine resin thereafter, and the pressure belt is manufactured by covering the substrate with the fluorine resin tube.

5. The image forming apparatus of claim 1, wherein the heating member has a belt shape and the pressure member has a roll shape, and wherein the heating belt is manufactured by forming silicone rubber on the substrate and coating with fluorine resin thereafter, and the pressure roll is manufactured forming a silicone rubber on the substrate and covering the silicone rubber with the fluorine resin tube.

6. The image forming apparatus of claim 1, wherein wax containing toner is used without mold releasing agent applied to the heating member having a roll shape and the pressure member having a roll shape.

7. The image forming apparatus of claim 1, wherein a temperature sensor for detecting a surface temperature of the heating member having a roll shape is provided without contacting a surface of the heating member in an image forming area, or in contact with the surface of the heating member outside the image forming area in an axis direction of the substrate, and a member for separating and guiding a transfer material from the heating member is provided without contacting the surface of the heating member.

8. The image forming apparatus of claim 1, wherein the heating member has a surface roughness from 1 to 5 μm and the pressure member has a surface roughness of 0.8 μm or smaller.

* * * * *